United States Patent [19]

Bryan, Jr.

[11] 4,166,542

[45] Sep. 4, 1979

[54] TELESCOPING LATTICE BOOM CRANE

[76] Inventor: John F. Bryan, Jr., 3212 Mapleleaf Cir., Dallas, Tex.

[21] Appl. No.: 857,604

[22] Filed: Dec. 5, 1977

[51] Int. Cl.[2] ..... B66C 23/04

[52] U.S. Cl. ..... 212/55; 52/118; 52/121; 212/59 R

[58] Field of Search ..... 212/55, 144, 58 R, 59 R; 52/118, 121

[56] References Cited

U.S. PATENT DOCUMENTS

| | | | |
|---|---|---|---|
| 2,819,803 | 1/1958 | Obenchain | 212/55 |
| 3,426,917 | 2/1969 | Siegel | 212/55 |
| 3,465,899 | 9/1969 | Reuter et al. | 212/55 |

*Primary Examiner*—Robert G. Sheridan

*Attorney, Agent, or Firm*—Richards, Harris & Medlock

[57] ABSTRACT

A lattice boom crane is provided with multiple boom sections which telescope one from the other to provide a variable length boom. A cable system is connected between the boom sections such that the boom sections are telescoped as the cable is drawn in by a winch mechanism. Cables drawn in by the winch mechanism is directed to a block system which is connected between a gantry structure and the point end of the outermost boom section. The winch mechanism includes two drums about which the cable is alternately wrapped. The block system expands at substantially the same rate as the boom sections extend. Thus, the boom angle, which is determined by the effective cable length between the gantry and the point of the boom, is not significantly effected. In one embodiment of the invention, the cable taken in by the block system is received on a boom hoisting drum which may be controlled to change the effective cable length between the gantry and the point of the boom to vary the boom angle. In a separate embodiment, a separate cable system connected in series with the block system is used to vary the effective length of the cable between the gantry and the point of the boom to vary the boom angle.

16 Claims, 10 Drawing Figures

TELESCOPING LATTICE BOOM CRANE

BACKGROUND OF THE INVENTION

1. Field of the Invention

This invention relates to cranes and more particularly to lattice boom cranes having boom sections which telescope to increase boom length.

2. Prior Art

The boom sections in telescoping cranes are generally extended and retracted by hydraulic cylinders which act between the boom sections. These designs have not included pendant lines and the boom has necessarily been designed as a cantilevered beam. The additional strength required to withstand these bending loads, which are not present in a pendant line supported lattice boom, has dictated the use of heavy fabricated structural sections for the boom.

While the telescoping crane design is beneficial because of the versatility of providing a variable length boom, the prior art structures have required such massive boom structures to support the hydraulic cylinders and associated structure used to telescope the boom sections that the capabilities of the crane have been limited. While this additional boom weight has not severely affected the crane capability at near vertical boom angles, the capacity of the crane has been substantially affected at the lower, near horizontal boom angles.

Therefore, although the lattice boom structure is normally preferred in a fixed boom length crane, heretofore this structure has not been feasible for use in telescoping cranes. While the telescoping cranes have been produced with solid wall boom sections, the capability of the crane has been severely limited due to the excessive weight introduced by the boom structure. Therefore, a need has arisen for a new configuration of crane which would provide a variable length boom with the payload capability of a lattice structure.

SUMMARY OF THE INVENTION

The present invention provides a crane with a telescoping or variable length boom. In accordance with one embodiment of the invention, the crane includes a base structure with a first boom section pivotally attached at one end to the base structure and a second boom section slidably received within the first boom section. A plurality of first sheaves are attached to the first boom section and a plurality of second sheaves are attached to the second boom section. The first sheaves are attached to the end of the first boom section remote from its point of attachment to the base structure, and the second sheaves attached to the second boom section are attached at or near the inner end of the second boom section. A cable is attached to the first boom section and entrained alternately around the second sheaves and the first sheaves such that drawing in the cable draws the second sheaves toward the first sheaves to telescope the second boom section longitudinally out of the first boom section.

According to one embodiment of the invention, a winch mechanism is provided for drawing the cable and includes a pair of drums spaced one from the other about which the cable is alternately wrapped. As the drums are rotated, the cable is drawn in or let out as desired.

Further to this embodiment of the invention, a cable block system is connected between the base structure and the point end of the boom section remote from the base. The block system receives the cable from the winch mechanism as cable is drawn in. The winch mechanism includes two drums having a plurality of grooves thereon for receiving the cable alternately wrapped therearound.

As the first and second sheaves are drawn together by the drawing in of the cable, the second boom section is telescopically extended from the first boom section. Simultaneously therewith, cable drawn in by the hoist mechanism is fed to the block system permitting the separation of the sheaves receiving the cable. Because the effective number of active line parts of the cable between the first sheaves and the second sheaves mounted on the boom sections equal the active line parts between the sheaves of the block system, the sheaves of the block system move apart at substantially the same rate as the second boom section telescopes from the first boom section. Because the block system is connected between the point end of the second boom section and the base structure and controls the angular position of the boom, the interaction of the block system and the telescoping of the boom maintains the boom angle substantially constant throughout telescoping of the boom. Inasmuch as the pendant length and the boom length are varied in equal increments, the locus of the point of the boom as it telescopes in and out closely approximates a line bisecting the angle between the pendant line path and the centroid of the boom.

In accordance with another embodiment of the invention, a boom hoisting drum is mounted on the base structure and receives the end of the cable from the block system. The drum may be selectively rotated to wind in the cable and thereby shorten the distance between the block system sheaves and thus rotate the boom through various vertical angles.

In accordance with still another embodiment of the invention, the boom is composed of a plurality of boom sections slidable one within the other with the base boom section being pivotally attached to the base structure. A cable system is connected between the boom sections such that the boom sections are telescoped one from the other as the cable is drawn in. In one embodiment of the invention, the boom includes four boom sections with the first boom section being pivotally attached to the base structure and the second boom structure slidably engaged within the first boom section, the third boom section slidably engaged within the second boom section, and the fourth boom section slidably engaged within the third boom section. A plurality of first sheaves are attached to the outer end of the first boom section remote from the point of pivotal connection to the base structure. A plurality of second sheaves are attached to the inner end of the second boom section and a plurality of third sheaves are attached to the outer end of the second boom section. A plurality of fourth sheaves are attached to the inner end of the third boom section and a plurality of fifth sheaves are attached to the outer end of the third boom section. A plurality of sixth sheaves are attached to the inner end of the fourth boom section.

In order to carry the compressive loads on the boom in a balanced manner, duplicate sheave systems are provided on opposite sides of the boom structure.

Cables are attached to the first boom section and entrained alternately between the second and first sheaves and thereafter entrained between the third and fourth sheaves of the second and third boom sections, respectively, and thereafter between the fifth and sixth sheaves on the third and fourth boom sections, respectively. The cables are thereafter engaged to a winch mechanism which selectively draws in the cables to telescope the fourth boom section from the third boom section, the third boom section from the second boom section and the second boom section from the first boom section. The number of sheaves in the first, second, third, fourth, fifth and sixth sheaves are so arranged that the effective active line parts between sheaves on adjacent boom sections are equal one to the other. Although the boom sections would extend simultaneously where there was no friction, because of frictional forces between the boom sections and within the sheave systems, the fourth boom section extends completely, then the third and then the second.

Further to this embodiment of the invention, the cable taken in from the winch mechanism is directed to a block system which is connected between the base structure and the point end of the fourth boom section. The block system includes at least two sets of sheaves. The cable is entrained alternately between the sheaves such that the active line parts therebetween equal the active line parts between sheaves of the adjacent boom sections. In this way, as cable is drawn in to telescopically extend the boom sections, the two sets of sheaves of the block system separate at substantially the same rate as the boom is extended. Thus, the boom angle, which is determined by the cable length between the base structure and the outermost tip of the boom, is not significantly affected.

In an alternative embodiment of the invention, the cables are attached to the fourth or outer boom section and then entrained between corresponding sheaves on the third and fourth boom sections and then between the second and third boom sections and thereafter the first and second boom sections. Thereafter, the cable is attached to the winch mechanism to be drawn in or let out as desired.

In accordance with still another embodiment of the invention, five boom sections make up the telescoping boom with the first boom section pivotally attached to the base structure and the remaining four boom sections being slidably received one within the other and in the first boom section. In this embodiment, one end of the cable system is used to telescope the third boom section from the second and the second from the first with the other end of the cable system being used to telescope the fifth boom section from the fourth and the fourth from the third.

Concurrently driven winch mechanisms are used to draw in or let out the two end sections of the cable system thus lengthening or shortening the central portion of the cable system, by a like amount. The central portion of the cable system is entrained around the sheaves of a block system connecting the point of the boom to the base structure. Inasmuch as this block system has the same number of active line parts as are used between the boom sheaves, the boom angle is maintained without substantial change throughout telescoping of the boom.

Further to this embodiment, a separate hoisting drum is used to control the length of the cable system from the base structure to the point end of the fifth boom section for purposes of varying the boom angle. This is accomplished by using a cable entrained alternately around opposed sheaves. The axes of these opposed sheaves are attached between the base structure and the outermost end of the fifth boom section. By controlling the length of cable between these opposed sheaves, the boom angle is varied.

DESCRIPTION OF THE DRAWINGS

For a more complete understanding of the present invention, and for further details and advantages thereof, reference is now made to the following description taken in conjunction with the accompanying drawings in which.

DESCRIPTION OF THE PREFERRED EMBODIMENTS

Figure 1:
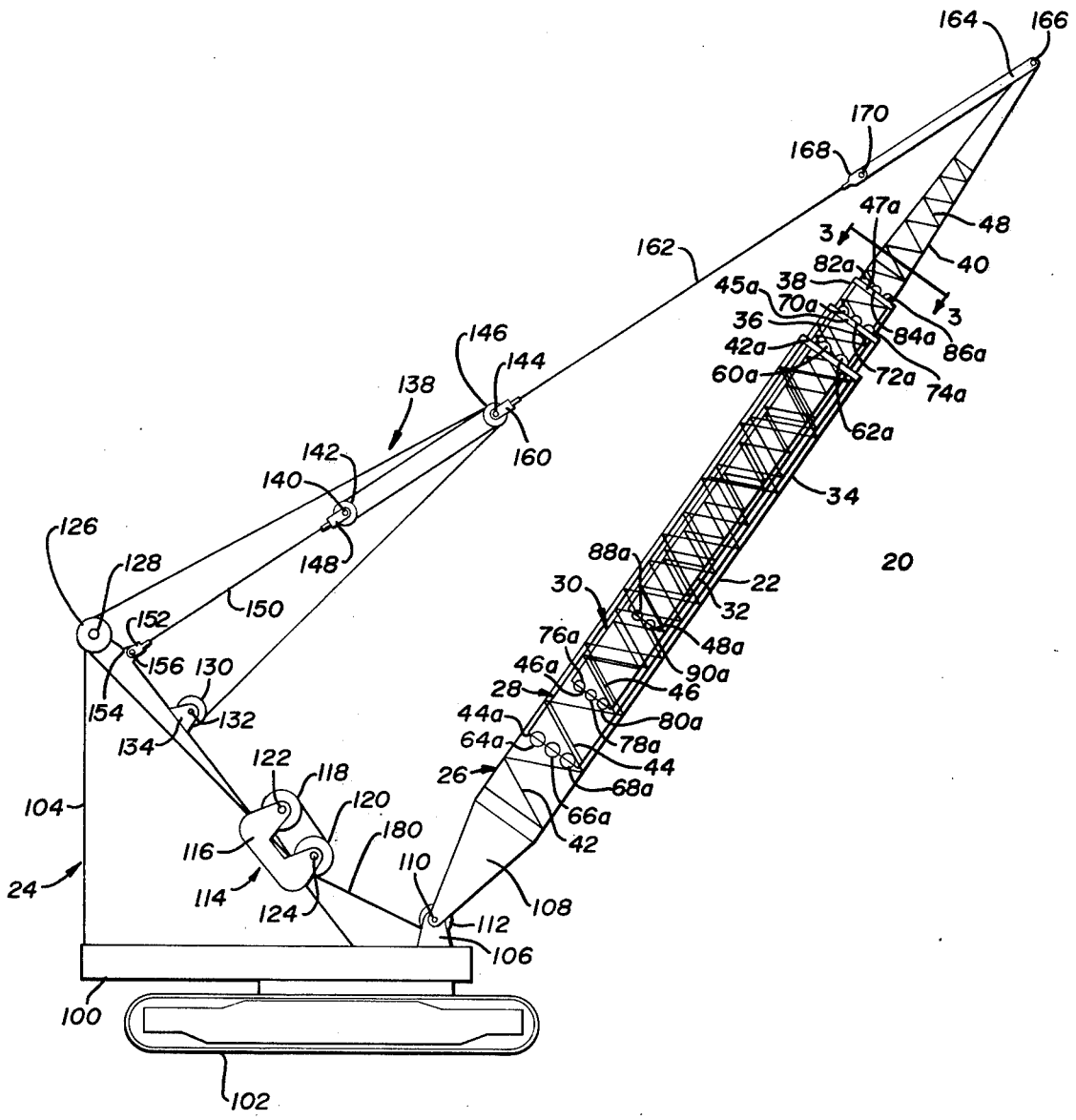
FIG. 1 illustrates a crane embodying the present invention with the boom in its retracted position.

FIG. 1 illustrates a crane 20 embodying the present invention and including a boom structure 22 pivotally attached to a base structure 24. The boom structure 22 includes boom sections 26, 28, 30 and 32 each constructed with longitudinal corner frames 34, 36, 38 and 40, respectively, supported and interconnected by a lattice framework made up of diagonal and transverse braces 42, 44–45, 46–47 and 48, respectively. Boom section 26 has a pair of rotatable sheaves **60*a* and 62*a* rotationally attached to transverse brace 42*a* at the upper end of boom section 26. As will be discussed hereinafter in greater detail, sheaves 60*a* and 62*a* are attached to the right side of boom section 26 and comparable sheaves (not shown in FIG. 1) are attached to the left side of the upper end of boom section 26**.

Sheaves **64*a*, 66*a* and 68*a* are rotationally attached to the lower end of boom section 28 on transverse brace 44*a*. At the upper end of boom section 28, sheaves 70*a*, 72*a* and 74*a* are rotatably attached to transverse brace 45*a***.

Boom section 30 is fitted with sheaves **76*a*, 78*a* and 80*a* rotatably attached to transverse brace 46*a*. The upper end of boom section 30 if fitted with sheaves 82*a*, 84*a* and 86*a* which are rotatably attached to transverse brace 47*a*. The lower end of boom section 32 is fitted with sheaves 88*a* and 90*a* which are rotatably attached to transverse brace 48*a***.

As will be discussed hereinafter in greater detail, boom section 32 is slidably received within boom section 30, boom section 30 is slidably received within boom section 28, and boom section 28 is received slidably within boom section 26.

Base 24 includes a platform 100 supported for movement on tracks 102. Platform 100 supports a gantry structure 104 and upstanding lugs 106. The lower extension 108 from boom section 26 is pivotally attached to lugs 106 at axis shaft 110 thereby providing for the rotation of boom section 26 relative to base 24.

An idler 112 is also fitted for rotation about axis shaft 110. A winch mechanism 114 is attached to gantry 104 and includes support frame 116 for supporting drums 118 and 120 for rotation about axis shafts 122 and 124, respectively. An idler 126 is attached for rotation about axis shaft 128 at the apex of gantry 104. A boom hoist drum 130 is rotatably received on axis shaft 132 supported from lugs 134 attached to gantry 104.

A telescoping and topping block system 138 is connected between gantry 104 and the point end of boom section 32. Block system 138 includes an axis shaft 140 with a plurality of sheaves 142 supported thereon and a second axis shaft 144 spaced from axis shaft 104 with a second plurality of sheaves 146 supported for rotation thereon. Axis shaft 140 is attached to a fitting 148 which is in turn connected by way of a fixed length cable 150 to a fitting 152 attached to a protruding ear 154 extending from gantry 104 by a pin 156. Axis shaft 144 is rotatably attached to a fitting 160 which is attached to the point end of boom section 32 by a fixed length cable 162 and a strap 164. Strap 164 is attached at pin 166 to the point end of boom section 32. Cable 162 is attached to the end of strap 164 remote from pin 166 by a fitting 168 joined to strap 164 by a pin 170.

A cable 180 is attached to boom section 26 and entrained around the sheaves attached to the various boom sections and around idler 112. Cable 180 is then alternately wrapped around drums 118 and 120 of winch mechanism 114, around idler 126, through block system 138 and then onto boom hoist drum 130.

Figure 2:
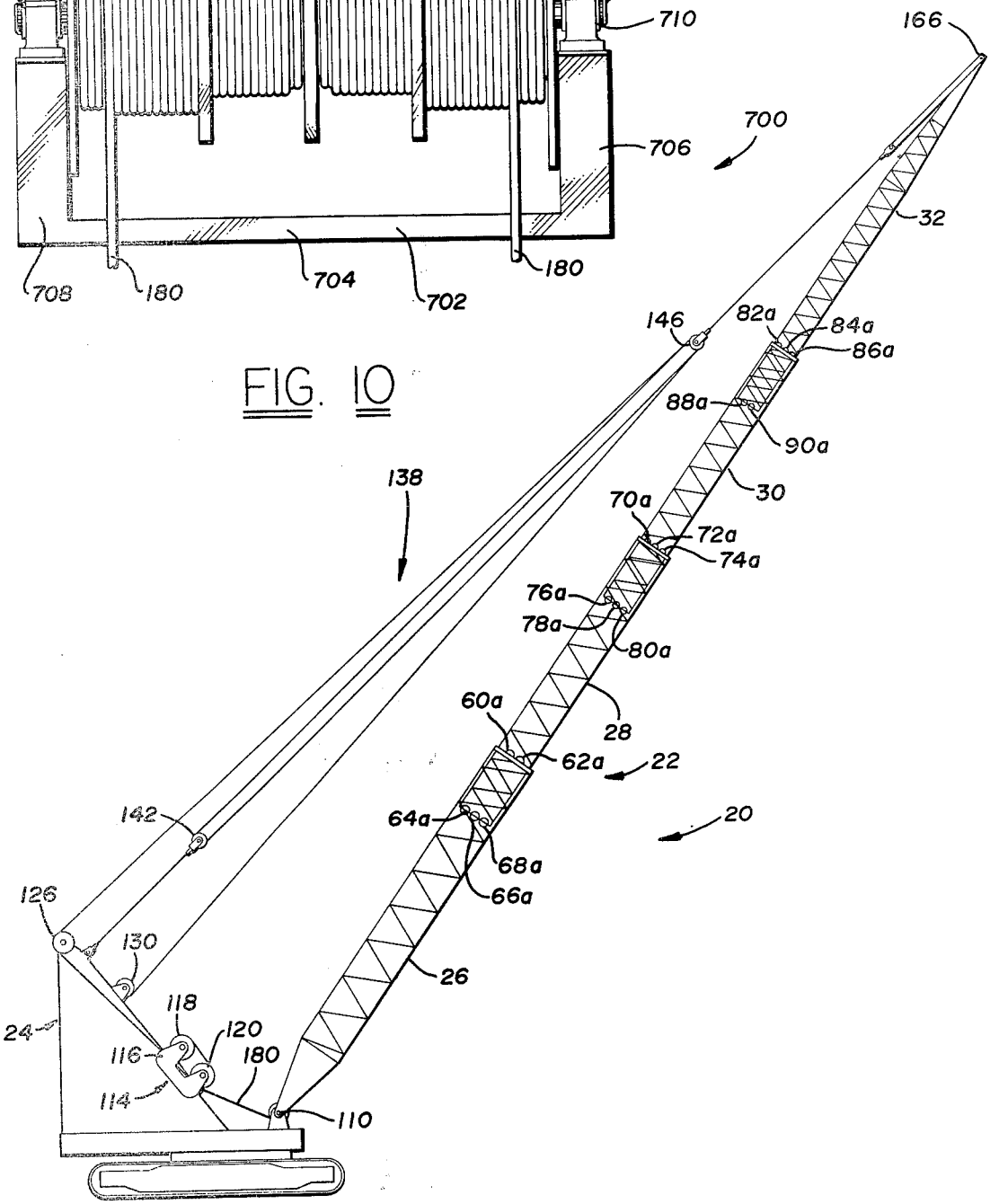
FIG. 2 illustrates the crane of FIG. 1 with the boom in its extended position.

FIG. 2 illustrates crane 20 with boom 22 in the extended position. Extension of boom 22 is accomplished by rotating drums 118 and 120 of winch mechanism 114 to draw in cable 180. As will be discussed hereinafter in greater detail, as cable 180 is drawn in, sheaves 88*a* and 90*a* are drawn toward sheaves 82*a*, 84*a* and 86*a* thereby telescoping boom section 32 out of boom section 30. Additionally, sheaves 76*a*, 78*a* and 80*a* are drawn toward sheaves 70*a*, 72*a* and 74*a* to telescope boom section 30 from boom section 28. Likewise, sheaves 64*a*, 66*a* and 68*a* are drawn toward sheaves 60*a* and 62*a* to telescope boom section 28 from boom section 26.

As cable 180 is drawn in by winch mechanism 114, the cable is fed around idler 126 into block system 138. As will be discussed hereinafter in greater detail, because the number of sheaves supported on boom 22 and the arrangement of cable 180 therearound, and further because the number of sheaves incorporated in block system 138, cable is provided to block system 138 to permit the movement of sheaves 146 away from sheaves 142 at substantially the same rate as boom section 32 moves relative to boom section 26.

During the extension of boom 22, boom hoist drum 130 is maintained stationary. However, by winding in cable onto drum 130, the positioning between sheaves 142 and 146 is altered. As the sheaves move together, boom 22 is rotated upwardly about the point of pivotal connection to base 24 at axis shaft 110. Similarly, as cable is fed out from boom hoist drum 130, sheaves 146 are permitted to move away from sheaves 142 thereby permitting the downward rotation of boom 22 about axis shaft 110.

Figure 3:
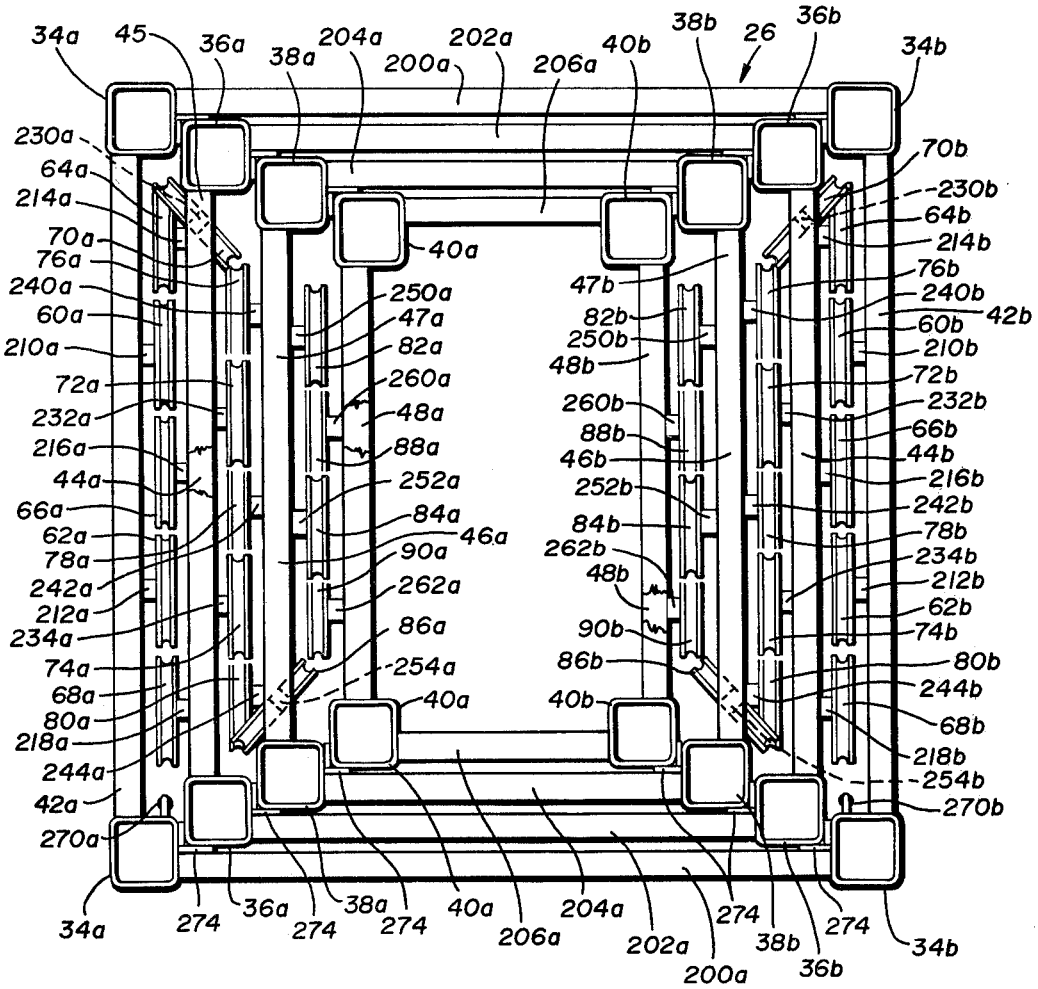
FIG. 3 is a section view taken along line 3—3 at FIG. 1.

FIG. 3 is a section view of boom 22 taken along line 3—3 in FIG. 1. As is illustrated in FIG. 3, each section is formed from four tubular longitudinal corner members interconnected by transversely extending struts. Boom section 26 includes tubular longitudinal frames 34*a* and 34*b*. These members are interconnected by transverse braces 42*a* and 42*b* to form the height of boom section 26, and are interconnected by top and bottom struts 200*a* to form the width of boom section 26. Similarly, the boom section 28 includes tubular longitudinal frames 36*a* and 36*b* interconnected by transverse braces 44*a* and 44*b* and top and bottom struts 202*a*.

Boom section 30 includes tubular longitudinal frames 38*a* and 38*b* interconnected by braces 46*a* and 46*b* and upper and lower struts 204*a*. Boom section 32 is formed with longitudinal frames 40*a* and 40*b* interconnected by braces 48*a* and 48*b* and upper and lower struts 206*a*.

Referring still to FIG. 3, sheaves 60*a* and 62*a* are rotatably mounted to brace 42*a* by shafts 210*a* and 212*a*, respectively. Similarly, on the opposite side of boom section 26, sheaves 60*b* and 62*b* are mounted to brace 42*b* by shafts 210*b* and 212*b*, respectively.

Sheaves 64*a*, 66*a* and 68*a* are attached to brace 44*a* by shafts 214*a*, 216*a* and 218*a*, respectively. On the opposite side of boom section 28, sheaves 64*b*, 66*b* and 68*b* are attached to brace 44*b* by shafts 214*b*, 216*b* and 218*b*, respectively.

Referring to boom section 28, and FIG. 3, sheaves 70*a*, 72*a* and 74*a* are attached to brace 44 by shafts 230*a*, 232*a* and 234*a*, respectively. Similarly, on the opposite side of boom section 28, sheaves 70*b*, 72*b* and 74*b* are attached to brace 44 by shafts 230*b*, 232*b* and 234*b*, respectively.

Regarding boom section 30, sheaves 76*a*, 78*a* and 80*a* are attached to brace 46*a* by axis shafts 240*a*, 242*a* and 244*a*, respectively. Similarly, corresponding sheaves 76*b*, 78*b* and 80*b* on the opposite side of boom section 30, are attached to brace 46*b* by axis shafts 240*b*, 242*b*, and 244*b*, respectively.

At the upper end of boom section 30, sheaves 82*a*, 84*a* and 86*a* are attached to brace 47*a* by axis shafts 250*a*, 252*a* and 254*a*, respectively. On the opposite side of the upper end of boom section 30, corresponding sheaves 82*b*, 84*b* and 86*b* are attached to brace 47*b* by shafts 250*b*, 252*b* and 254*b*, respectively.

Referring to boom section 32, sheaves 88*a* and 90*a* are attached to brace 48*a* by axis shafts 260*a* and 262*a*, respectively. Similarly, on the opposite side of boom section 32, corresponding sheaves 88*b* and 90*b* are rotationally attached to brace 48*b* by axis shafts 260*b* and 262*b*.

Fittings 270*a* and 270*b* are fixedly attached to longitudinal frames 34*a* and 34*b* of boom section 26.

Referring still to FIG. 3, angles 274 are secured, as by welding, along each of the longitudinal frames 34, 36 and 38 adjacent to corresponding frames 36, 38 and 40, respectively. These angles are not only attached to the frames but are also attached to the corresponding frame struts 200, 202, 204 and facilitate the sliding of one boom section relative to an adjacent boom section.

Figure 4:
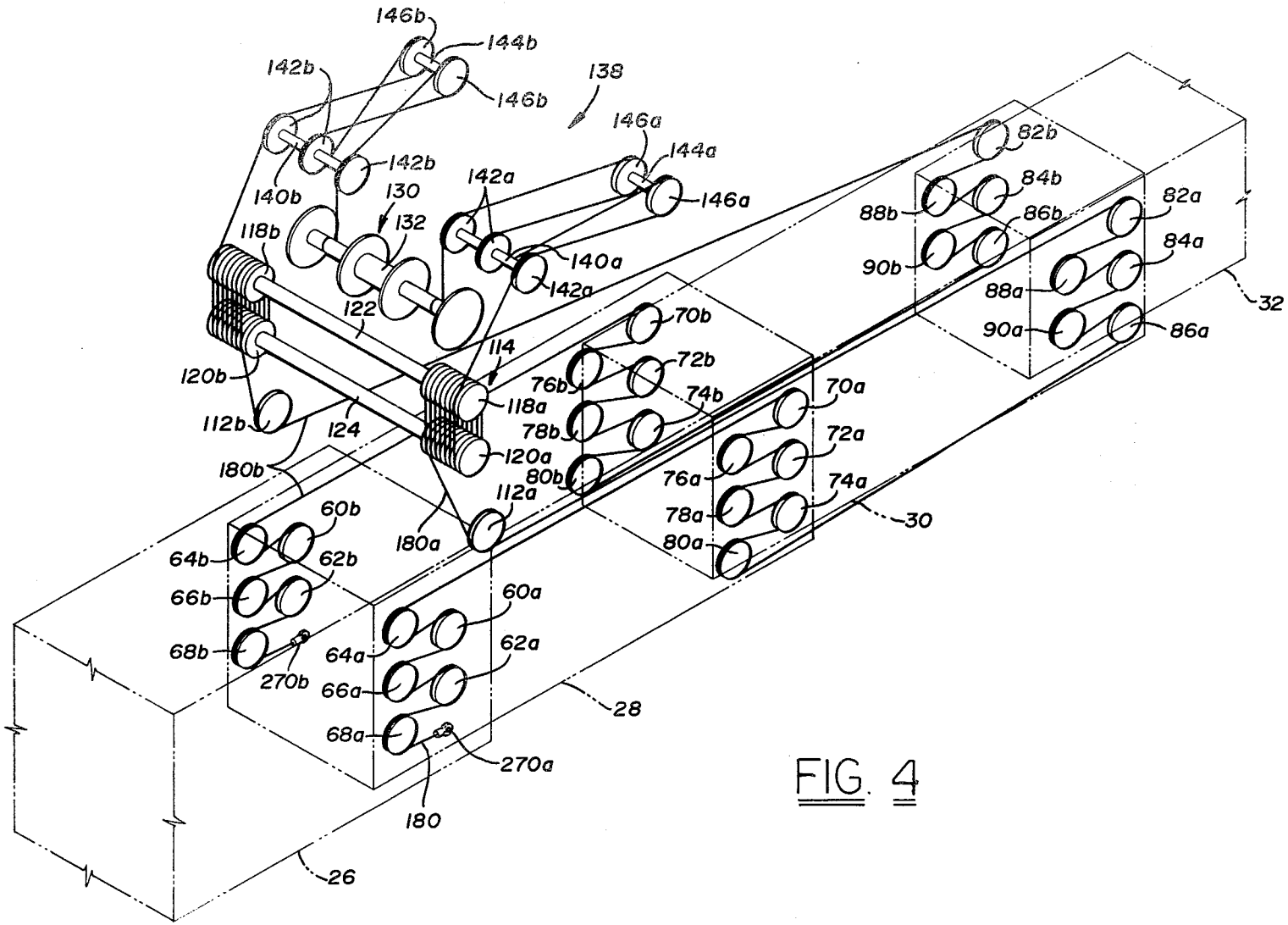
FIG. 4 is a perspective diagrammatic view of one embodiment of the present invention for extending the boom.
Figure 5:
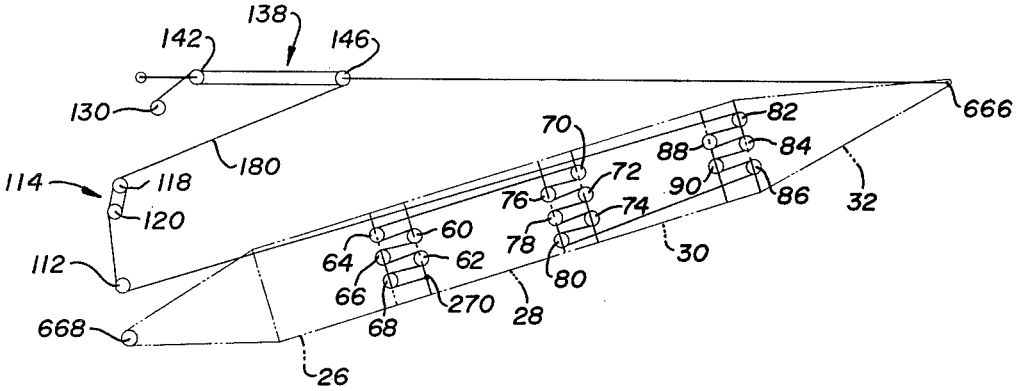
FIG. 5 is a schematic view of the embodiment illustrated in FIG. 4.

FIGS. 4 and 5 are a diagrammatic and schematic illustration of the crane illustrated in FIGS. 1–3. In FIG. 4, the frame outline of boom sections 26, 28, 30 and 32 are illustrated in phantom. As discussed with respect to FIG. 2, fittings 207*a,b* and sheaves 60*a,b* and 62a,b are attached to boom section 26. Sheaves 64a,b, 66a,b, and 68a,b are attached to the lower end of boom section 28 while sheaves 70a,b, 72a,b and 74a,b are attached to the upper end. Sheaves 76a,b 78a,b and 80a,b are attached to the lower boom section 30 and sheaves 82a,b 84a,b and 86a,b are attached to the upper end of boom section 30. Sheaves 88a,b and 90a,b are attached to the lower end of boom section 32.

FIG. 4 further illustrates in diagrammatic form idler sheaves 112a and 112b and drums 118a,b and 120a,b of winch mechanism 114. Drums 118a,b and 120a,b are formed with multiple grooves therearound and are supported on spaced axis shafts 122 and 124.

FIG. 4 illustrates sheaves 142a,b and 146a,b supported for rotation on shafts 140a,b and 144a,b, respectively, as hereinabove discussed. Boom hoist drum 130 supported on shaft 132 is also illustrated.

Referring still to FIGS. 4 and 5, cable 180a is attached to boom section 26 at fitting 270a and is entrained alternately around sheaves 68a, 62a, 66a, 60a and 64a. Thereafter, the cable is entrained alternately around sheaves 70a, 76a, 72a, 78a, 74a and 80a. The cable continues and is entrained around sheaves 86a, 90a, 84a, 88a, and 82a and further around idler sheave 112a and onto winch mechanism 114. Cable 180 is alternately wrapped around drums 118a and 120a, and alternately wrapped between the sheaves 142a and 146a of block system 138. Thereafter, the end of the cable is engaged on boom hoist drum 130.

A similar cable 180b is routed identically from the fitting 270b on boom section 26 around the sheaves on the opposite side of the boom and through the corresponding winch mechansim and telescoping and topping block system on the opposite side of the boom and then onto boom hoist drum 130. Because cables 180a and 180b are driven simultaneously as they are drawn in or let out, and the arrangement of the sheaves is identical on each side of the crane, reference will hereinafter be made to the cables and sheaves without use of the suffixes a and b. It will be understood that the reference is to the cable and sheaves on both sides of the crane.

In operation of the crane illustrated in FIGS. 1–5, the drums 118 and 120 of winch mechanism 114 are rotated by a suitable prime mover (not shown) to draw in cable 180. As cable is drawn in, sheaves 88 and 90 of boom section 32 are moved toward sheaves 82, 84 and 86 of boom section 30. Likewise, sheaves 76, 78 and 80 are moved toward sheaves 70, 72 and 74 of boom section 28, and sheaves 64, 66 and 68 are carried toward sheaves 60 and 62 of boom section 26. As a result, boom section 32 is telescoped from boom section 30, boom section 30 is telescoped from boom section 28 and boom section 28 is telescoped from boom section 26.

Referring to FIG. 4, as cable 180 is drawn in to extend boom section 32, four sections of cable, namely the cable between sheaves 82 and 88, 88 and 84, 84 and 90, and 90 and 86, will shorten. This cable is drawn into winch mechanism 114 and supplied to block system 138. After boom section 32 has been completely extended and as boom section 30 telescopes from boom section 28, there are five cable lengths between sheaves 70, 72 and 74 and 76, 78 and 80 which will shorten. However, because sheaves 76, 78 and 80, attached to boom section 30 are moving away from idler 112, winch mechanism 114 will effectively only be receiving cable equivalent to four line parts. Similarly, as boom section 28 is extended from boom section 26, effectively only four line parts between the respective sheaves on these boom sections will be taken in by winch mechanism 114.

The block system 138 also is constructed with four active line parts between sheaves 142 and 146. In this way, as the boom sections telescope one from the other, sheaves 142 and 146 separate at the same rate as the boom sections extend, thereby permitting the boom sections to telescope along a line defined by the longitudinal axes of the sections. With boom hoist drum 130 stationary, the boom extends and retracts without any significant change in the boom angle.

Therefore, in operation of the unit, the boom sections are extended by rotating winch mechanism 114 to draw in cable 180. As a result of the friction in the system, boom section 32 is first extended from boom section 30 until the section engages stops (not shown) which arrest extension of boom section 32. Cable drawn in by winch mechanism 114 is fed to block system 138, and sheaves 146 are permitted to move away from sheaves 142 at substantially the same rate at which boom section 32 extends relative to the stationary boom sections.

After boom section 32 has been fully extended, boom section 30 is telescoped from boom section 28 as sheaves 76, 78 and 80 of boom section 30 are drawn toward sheaves 70, 72 and 74 of boom section 28. Again, the line drawn in by winch mechanism 114 is fed to block system 138 to permit the extension of the boom sections without any significant change in the boom angle.

When boom section 30 has been fully extended, boom section 28 is extended similarly from boom section 26 as sheaves 64, 66 and 68 of boom section 28 are drawn toward sheaves 60, 62 and fitting 270 attached to boom section 26. As boom section 28 extends from boom section 26, cable drawn in by winch mechanism 114 is continuously fed to block system 138. This feeding of cable into block system 138 permits the movement of sheaves 146 away from sheaves 142 at a rate equal to the rate of extension of boom section 28 from boom section 26. Thus, as is illustrated in FIGS. 1 and 2, the boom moves from the collapsed (FIG. 1) to the full extended position (FIG. 2) without a substantial change in the boom angle.

Thereafter, or simultaneously with the extension of the boom, the boom angle may be raised or lowered by drawing in or letting out cable from the boom hoist drum 130. As cable is drawn in by drum 130, the distance between sheaves 146 and 142 of telescoping and topping block assembly 138 is shortened thereby rotating the boom upwardly. By letting out cable from drum 130, the distance between sheaves 146 and sheaves 142 is increased thereby permitting the downward rotation of boom 22 about its point of attachment to base 24.

Figure 6:
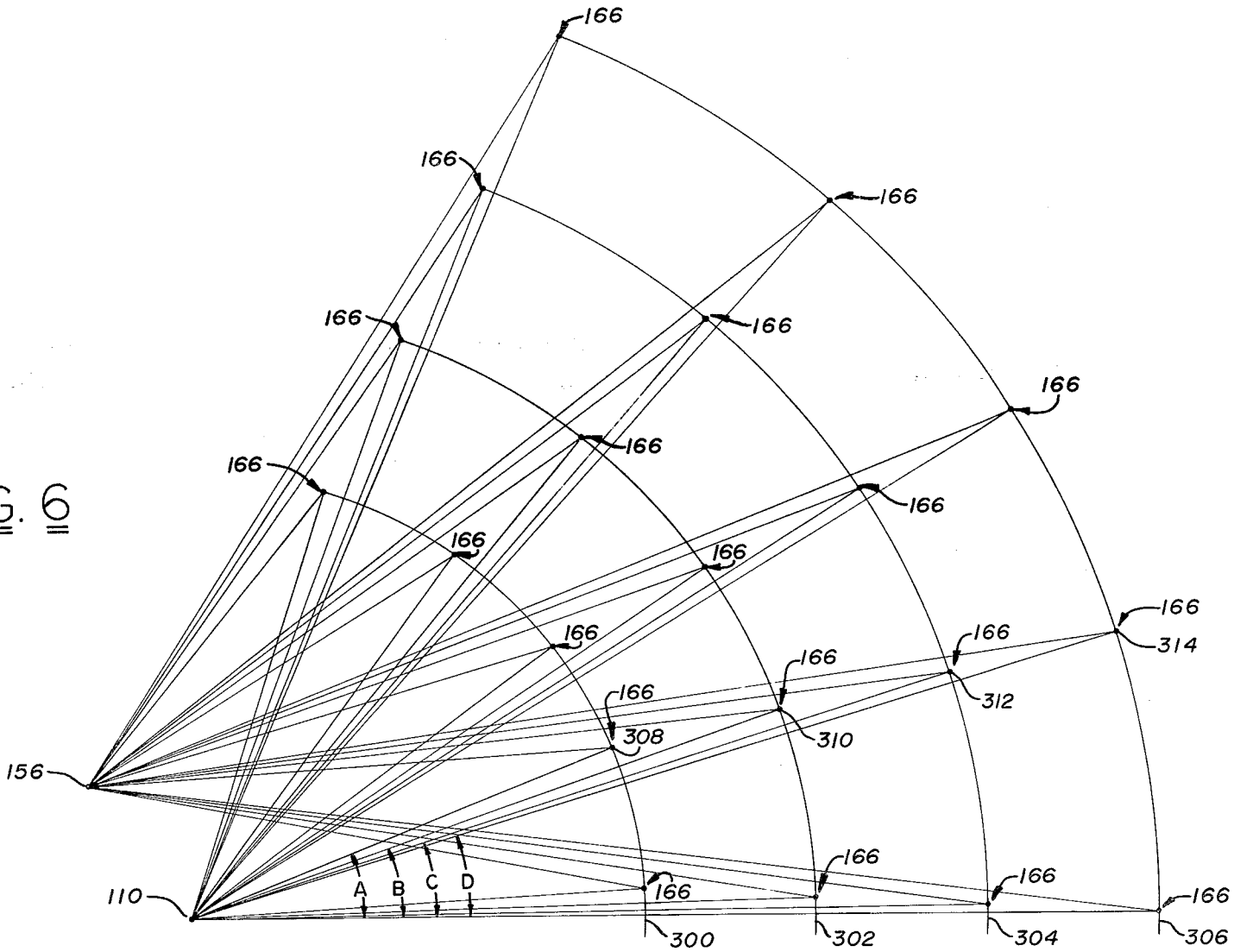
FIG. 6 is a diagrammatic representation of the movement of the boom during extension and retraction at various boom angles.

FIG. 6 illustrates in diagrammatic form the various positions which the boom of a crane of the present invention may assume. The point indicated by the numeral 110 corresponds to the axis shaft 110 attaching the lower end of boom section 26 to the lugs 106 on platform 100. Point 156 corresponds to the pin 156 connecting fitting 152 to gantry 104 from which cable 150, telescoping and topping block system 138 and cable 162, and thus the uppermost point of boom 22, is attached. Numeral 166 corresponds to pin 166 (FIG. 1) and thus identifies the uppermost point of boom section 32 of boom 22.

The arc identified by numeral 300 represents the path followed by the end of boom 22 when in the completely retracted position as the boom is moved through various boom angles. The arc identified by numeral 302 identifies the path followed by the end of the boom with boom section 32 fully extended as the boom is moved to various boom angles. Likewise, the arc identified by numerals 304 and 306 are the paths followed by the ends of boom 22 with boom section 30 extended and boom section 28 extended, respectively, as the boom is moved through various boom angles.

FIG. 6 further illustrates the effect on the boom angle as the boom sections are extended. For example, with the boom completely retracted at a boom angle A, point 166 would be positioned at location 308 on arc 300. When boom section 32 is fully extended from boom section 30, point 166 is positioned at the location identified by numeral 310 on arc 302. The boom angle is then seen to be adjusted to an angle B, slightly less than the angle A which the boom assumed prior to the extension. When boom section 30 is fully extended from boom section 28, the end of the boom assumes the position identified by numeral 312 on arc 304. Thus, the boom assumes a boom angle C at this point, slightly less than boom angle B which the boom assumed prior to the extension of boom section 30. In the fully extended position, the end of boom 22 assumes the position identified by numeral 314 on arc 306 with a boom angle D. Angle D is again slightly less than angle C, the boom angle prior to the extension of boom section 28 from the boom section 26. Thus, the extension of the boom at any boom angle results in a slight lowering of the boom angle, although the change in the boom angle is minimal.

Figure 8:
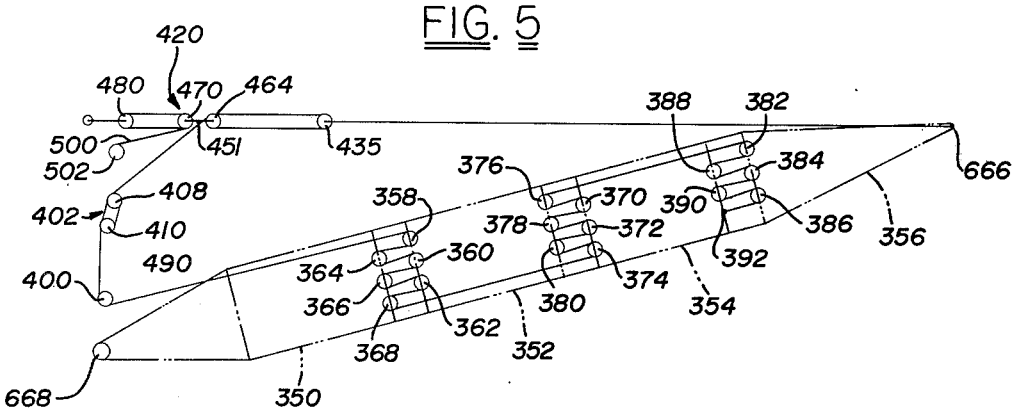
FIG. 8 is a schematic view of the embodiment illustrated in FIG. 7.
Figure 7:
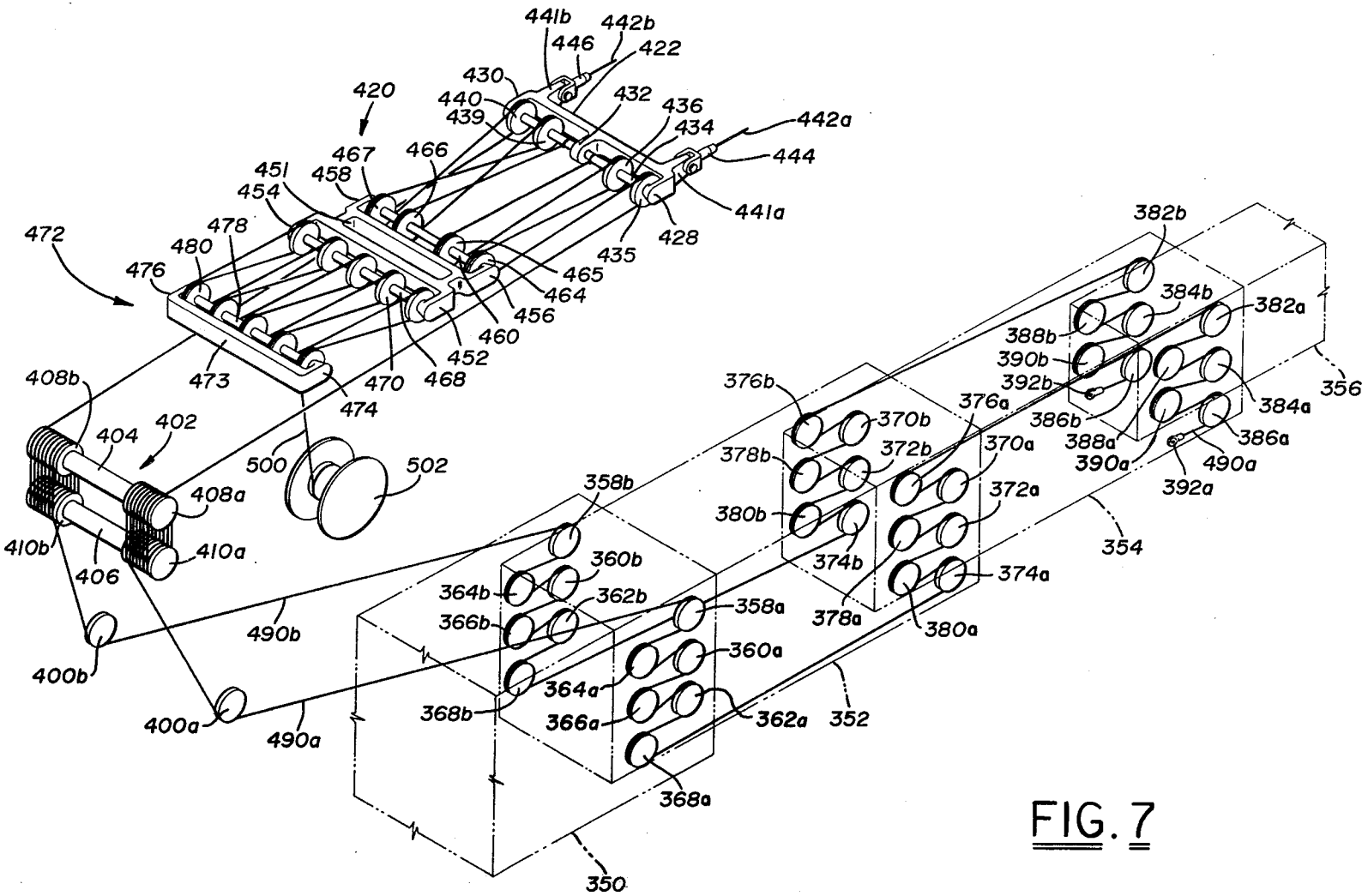
FIG. 7 is a diagrammatic view of an alternative embodiment of the present invention for extending the boom.

FIGS. 7 and 8 are diagrammatic representations of an alternative arrangement of the actuation cable and its attachment to the boom sections. Similar to the embodiment illustrated in FIGS. 1–5, the crane of FIGS. 7 and 8 includes four boom sections which telescope one from the other. Boom section 350 receives a boom section 352, boom section 352 receives a boom section 354 and boom section 354 receives a boom section 356. The upper end of boom section 350 is fitted on one side with sheaves 358*a*, 360*a* and 362*a*. The lower end of boom section 352 is fitted with sheaves 364*a*, 366*a* and 368*a* and the upper end is fitted with sheaves 370*a*, 372*a* and 374*a*. The lower end of boom section 354 is fitted with sheaves 376*a*, 378*a* and 380*a* and the upper end is fitted with sheaves 382*a*, 384*a* and 386*a*. The lower end of boom section 356 is fitted with sheaves 388*a*, 390*a* and a fitting 392*a*. While only those sheaves on the near side of the boom (as viewed from FIGS. 7 and 8) have been called out, the far side of the boom likewise is fitted with an identical arrangement of sheaves identified by the same number as their counterpart on the near side except with the substitution of the suffix b for the suffix a.

Idler sheaves 400*a* and 400*b* are attached to boom section 350, and a winch mechanism 402, similar to winch mechanism 114 illustrated and described with respect to FIGS. 1, 2 and 4, is attached to the superstructure of the crane base. Winch mechanism 402 includes a pair of spaced shafts 404 and 406 each supporting drums 408*a*, 408*b* and 410*a*, 410*b*, respectively. The unit further includes a telescoping block system 420 and a topping block system 472 which are interconnected between the gantry and the point end of boom section 356. Telescoping block system 420 includes a frame 422 with a pair of lugs 428 and 430 extending inwardly therefrom. Lugs 428 and 430 support an axis shaft 434 which in turn receives a plurality of telescoping block system sheaves 435, 436, 439, 440 for rotation thereon. A pair of lugs 441*a* and 441*b* extend outwardly from frame 422. Pendant lines 442*a* and 442*b* are attached to lugs 428 and 430 through fittings 444 and 446, respectively.

Telescoping block system 420 further includes a connecting frame 451 having a pair of lugs 456 and 458 extending from one side of the base and a similar pair of lugs 452 and 454 extending from the opposite side. Lugs 456 and 458 support axis shaft 460 on which telescoping block system sheaves 464, 465 and 466, 467 are mounted. Lugs 452 and 454 support an axis shaft 468 and a plurality of topping block system sheaves 470 for rotation thereon.

Topping block system 472 further includes a third frame 473 having a pair of lugs 474 and 476 extending from the ends thereof. Lugs 474 and 476 support an axis shaft 478 and a plurality of topping block system sheaves 480 for rotation thereon. Although not shown in FIG. 7, frame 473 is attached by suitable structure, such as cables, to the gantry.

In this embodiment of the invention, cables 490*a* and 490*b* are attached to fittings 392*a* and 392*b*, respectively. Cable 490*a* is alternately entrained around sheaves 386*a*, 390*a*, 384*a*, 388*a*, and 382*a*. Thereafter, cable 490*a* is alternately entrained around sheaves 376*a*, 370*a*, 378*a*, 372*a*, 380*a*, and 374*a*. Cable 409*a* is then entrained alternately around sheaves 368*a*, 362*a*, 366*a*, 360*a*, 364*a* and 358*a*. Cable 490*a* is directed around idler sheave 400*a*, wound alternately between drums 408*a* and 410*a* of hoist mechanism 402 and thereafter entrained alternately between sheaves 435, 464, 436, and 465. Cable 490*a* is tied by suitable fitting (not shown) to shaft 434.

In a similar fashion, cable 490*b* is attached to fitting 392*b* and is entrained following the same pattern about the sheaves on the opposite side of the boom, around idler sheave 400*b* and alternately around drums 408*b* and 410*b* of winch mechanism 402. Cable 490*b* is alternately entrained between sheaves 439 and 440 and sheaves 466 and 467 supported between frames 422 and 451 of telescoping block system 420. Cable 490*b* is then tied to shaft 434.

In this embodiment, boom sections 356, 354 and 352 are extended by drawing in cables 490*a* and 490*b* much in the same manner illustrated and described with respect to the embodiment of FIGS. 1–4. As will be noted from FIG. 7, there are five active line parts between the set of sheaves on adjacent boom sections and also between those sheaves supported in telescoping block system 420 between frames 422 and 451. Therefore, as the boom sections are extended one from the other, the sheaves supported by frame 422 and those supported by frame 451 separate at substantially the same rate as the extension of the boom sections.

Retraction of the boom sections is accomplished in the reverse manner to extension. The telescoping block system is shortened, applying an inward force to the outermost end of the boom. The line length taken from the telescoping block system is supplied to the boom sheave system, allowing it to retract as a result of the telescoping block system tension force applied to the outermost boom section.

A separate cable 500 is attached to frame 473 of topping block system 420 and is alternately entrained between sheaves 480 and 470. Cable 500 is then attached to a boom hoisting drum 502 which is operated to selectively draw in or let out cable 500 as desired. By drawing in cable 500, frame 451 is drawn toward frame 473 thereby decreasing the distance between the crane gantry and the point end of boom section 356. In this way, the boom is rotated upwardly. By letting out cable from boom hoisting drum 502, frame 451 moves away from frame 473 thereby lowering the boom.

Figure 9:
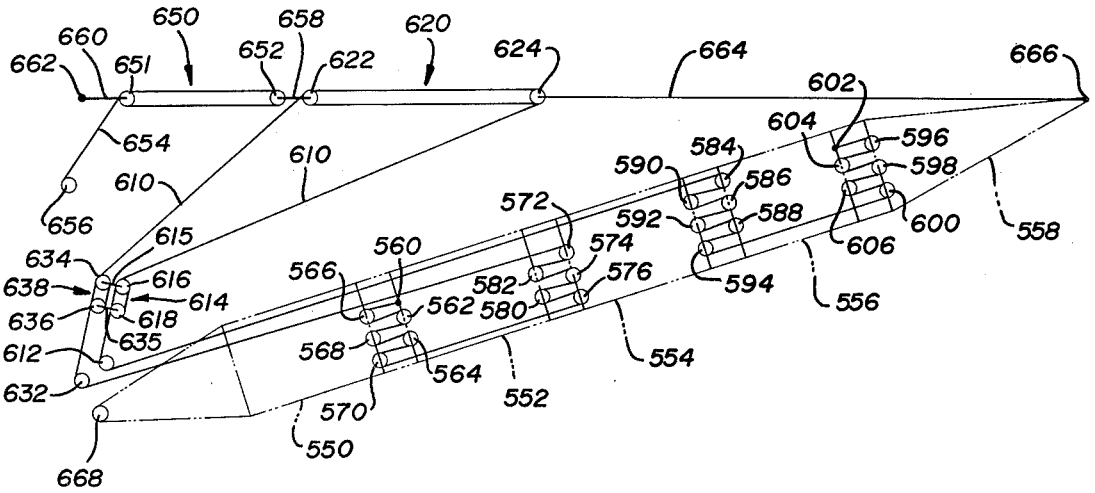
FIG. 9 is a schematic representation of an alternative arrangement of the present invention for extending the boom.

FIG. 9 illustrates an alternative embodiment of a cable arrangement for extending the boom sections. The arrangement illustrated may be used where three or more boom sections make up the boom. In this embodiment, a boom section 550 receives a second boom section 552, boom section 552 receives a third boom section 554, boom section 554 receives a fourth boom section 556, and boom section 556 receives a fifth boom section 558. Sheaves 562, 564 and cable end fitting 560 are attached to the upper end of boom section 550 and sheaves 566, 568 and 570 are attached to the lower end of boom section 552. Sheaves 572, 574 and 576 are attached to the upper end of boom section 552. The lower end of boom section 554 is fitted with sheaves 580 and 582. The upper end of boom section 554 is fitted with sheaves 584, 586, and 588. The lower end of boom section 556 is fitted with sheaves 590, 592 and 594. The upper end of boom section 556 is fitted with sheaves 596, 598 and 600. The lower end of boom section 558 has a cable fitting 602 and sheaves 604 and 606 attached thereto.

In this embodiment, a separate cable is used on each side of the crane boom in order to telescope the various boom sections one from the other. FIG. 9 illustrates only one side of the unit, the opposite side being identical to that shown in FIG. 9. A cable 610 is attached to cable fitting 602 on boom section 558 and alternately entrained around sheaves 596, 604, 598, 606, and 600. Thereafter, cable 610 is alternately entrained around sheaves 594, 588, 592, 586, 590, and 584. Cable 610 is then guided around idler sheave 612 to winch unit 614 which includes a pair of grooved drums 616 and 618 about which cable 610 is alternately wrapped. Cable 10 then is directed to telescoping block system 620 which includes spaced sets of sheaves 622 and 624.

The other end of cable 610 is attached at fitting 560 and alternately entrained around sheaves 566, 562, 568, 564, and 570. Thereafter the cable is alternately wrapped around sheaves 576, 580, 574, 582, and 572. Cable 610 is then directed around idler sheave 632 and alternately wrapped around drums 634 and 636 of hoist unit 638. Cable 610 is thereafter directed to telescoping block system 620 where it is alternately entrained between the sheave sets 622 and 624.

Drums 616 and 634 are mounted on a common driving shaft 615 and rotate together. This is also the case with drums 618 and 636 which are mounted on a common driving shaft 635.

In this embodiment of the invention, cable 610 is drawn in to simultaneously extend boom section 558 from boom section 556, boom section 552 from boom section 550 and then boom section 556 from boom section 554 simultaneously as boom section 554 is extended from boom section 552.

In the embodiment of the invention shown in FIG. 9 there are four active parts of line on each side working between boom sections 550 and 552, four active parts of line on each side working between boom sections 552 and 554, four active parts of line on each side working between boom sections 554 and 556 and four active parts of line on each side between boom sections 556 and 558.

The telescoping block system sheave sets 622 and 624 are arranged so as to provide eight parts of line, four for each side, thus enabling the block system length to change at the same rate as the boom length changes.

Referring still to FIG. 9, topping block system 650 also includes sets of sheaves 651 and 652 which receive a cable 654 therearound. Cable 654 has one end attached to boom hoist drum 656. Sheaves 652 are attached to sheaves 622 by a suitable support 658 and sheaves 651 are attached by support 660 to a point 662 on the gantry of the crane. Sheaves 624 of telescoping block system 620 are attached by pendant line 664 to a point 666 at the point end of boom section 558. By drawing in or letting out cable 654 between sheaves 651 and 652 the distance between points 662 and 666 is controlled, thereby controlling the angle of rotation of the boom sections about a pivot point 668 at the base of boom section 550. In this way, the boom angle is controlled by a unit independent of the mechanism used to extend and retract the boom sections.

Figure 10:
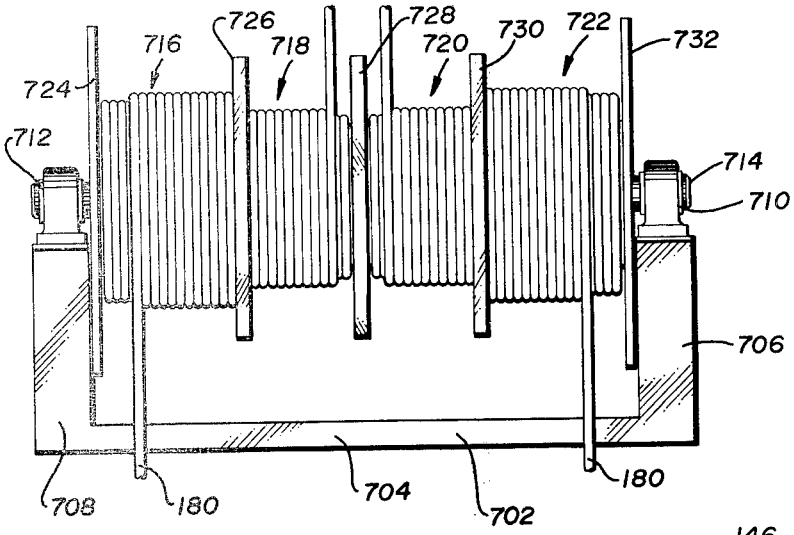
FIG. 10 is a plan view of an alternative hoist unit of the present invention.

FIG. 10 illustrates an alternative system for drawing in cable to extend the boom sections. This system also supplies line to the end of the outermost boom section at substantially the same rate at which line is drawn in. Thus, the boom angle, controlled by the line to the end of the outermost boom section, remains substantially constant during extension of the boom.

FIG. 10 illustrates a winch mechanism 700 including a frame structure 702 having a back 704 with two upstanding legs 706 and 708 extending upwardly from the back. The ends of legs 706 and 708 remote from their connection to back 704 are fitted with suitable bearing assemblies 710 and 712, respectively, for receiving a shaft 714 for rotation therein. Shaft 714 supports a drum assembly 715 divided into four sections, namely 716, 718, 720 and 722. The sides of these sections are defined by circular dividing walls 724, 726, 728, 730 and 732. These walls are each attached to shaft 714 and rotate with the shaft. A drum core (not shown) is fitted between each of the circular dividing walls 724–732 and rotates with shaft 714. Although not shown in FIG. 10, shaft 714 is driven by a suitable prime mover. Cable is wound onto sections 716 and 722 in one direction while cable wound onto the drum cores of sections 718 and 720 is wrapped in the opposite direction.

Winch mechanism 700 replaces winch mechanism 114 illustrated in FIGS. 1–5. The unit is attached to the crane by attaching frame 702 to base structure 24 illustrated in FIGS. 1 and 2. In the use of unit 700, cable entrained around the various sheaves on the differing boom sections, such as cable 180 of the embodiment illustrated in FIG. 4, is attached to and wound onto sections 716 and 722. The cable wound onto sections 718 and 720 are attached from the unit to a telescoping block system such as block system 138 (FIG. 1).

Where unit 700 is substituted for hoist 114 (FIG. 1), the boom sections are extended by rotating shaft 714 to wind in cable 180 onto sections 716 and 722. Simultaneously therewith, cables from sections 718 and 720 are fed out to telescoping block system 138 corresponding to the outer movement of the upper end of the boom. Because the effective diameters of the drums for the sections 716–722 will vary according to the amount of cable wound thereon, the cable being drawn in will not exactly equal that cable fed from the unit. However, this difference can be minimized by increasing the drum cores such that the effective diameters of the sections will be substantially equal.

Because the amount of line taken in only differs slightly from that line released from the unit, the change in the boom angle resulting from this difference will be minimal. Moreover as the boom is extended, line is supplied to the telescoping block system at a diminishing ratio relative to the rate at which line is taken from the boom telescoping system. This counteracts the tendency for the boom angle to lower slightly as the boom is extended and thus the boom may be extended or retracted without substantially affecting the boom angle.

Thus, the present invention provides a crane having a telescoping or variable length boom. The boom includes a plurality of boom sections formed with a lattice type construction. According to one embodiment of the invention, the crane includes a base structure having a first boom section pivotally attached at its lower end to the base structure and a second boom section slidably received within the first boom section. The second boom section slidably receives a third boom section therein and the third boom section slidably receives a fourth boom section within its structure.

At least one rotatable sheave is attached to the upper end of the first boom section, to both the lower and upper ends of the second and third boom sections and to the lower end of the fourth boom section. A cable is attached to the first boom section and is alternately entrained between corresponding sets of sheaves between the various boom sections and thereafter attached to a winch mechanism. By drawing in the cable, each boom section is telescoped from the adjacent boom section in which it is nested. The cable drawn in by the winch mechanism is fed to a telescoping block system which includes spaced sets of sheaves about which the end of the cable is alternately entrained. These spaced sets of sheaves are connected between a superstructure extending from the base of the crane and the point end of the outermost boom section. Because of the arrangement of the number of sheaves used to telescope the various boom sections as compared to the number of sheaves and active line parts in the telescoping block system, the end of the boom is extended at substantially the same rate at which the sets of sheaves in the telescoping block system move apart as cable is fed thereto. In this way, the boom sections are extended without significantly affecting the boom angle.

A boom hoisting drum receives the cable after it is wound on the telescoping block system and controls the boom angle by drawing in or letting out cable to control the separation of the plurality of sheaves in the block system.

In an alternative embodiment, the cable engaged around the sheaves in the telescoping block system is separate from the boom hoist. A similar unit having a pair of spaced sheaves and receiving a cable from a boom hoisting drum is attached in series with the telescoping block system between it and the superstructure of the crane base. In this embodiment, the boom angle is adjusted by the separate cable arrangement associated with the boom hoisting drum.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the appended claims.

What is claimed is:

1. A crane comprising:

a first boom section pivoted at one end to a base, a second boom section extending from the other end of the first boom section and slidable longitudinally relative to said first boom section, at least one first sheave attached to the first boom section, at least one second sheave attached to the second boom section, topping means including a first block system comprised of sets of sheaves secured between the base and the second boom section, at least one cable having one end fixed to one of the boom sections and extending about the first and second sheaves to the first block system, and means located between the first boom section and the topping means for actuating the cable to selectively translate the second boom section and adjust the topping means.

2. The crane according to claim 1 wherein said means for actuating said cable means comprises:

a winch mechanism about which said cable is wrapped, and means for selectively rotating said winch mechanism to draw in or let out said cable.

3. The crane according to claim 1 wherein the effective line parts of said cable between said first sheaves and said second sheaves mounted on said boom sections equal the effective line parts between the sets of sheaves of said first block system such that the sets of sheaves of said first block system move apart at substantially the same rate as said second boom section moves relative to said first boom section.

4. A crane comprising:

a first boom section, a second boom section slidable longitudinally relative to said first boom section, a cable means connected between said first and second boom sections for translating said second boom section relative to said first boom section, means for actuating said cable means to translate said second boom section relative to said first boom section, said cable means comprising:

at least one first sheave attached to said first boom section, at least one second sheave attached to said second boom section, and a cable entrained alternately around said second sheaves and said first sheaves, such that drawing in said cable draws said second sheaves toward said first sheaves to translate said second boom section relative to said first boom section, said means for actuating said cable means comprising:

a winch mechanism about which said cable is wrapped, and means for selectively rotating said winch mechanism to draw in or let out said cable, a base structure pivotally supporting the end of said first boom section remote from said second boom section, a first block system connecting said base structure and the end of said second boom section remote from said first boom section for receiving said cable from said winch mechanism, said first block system including two spaced sets of one or more sheaves for alternately receiving said cable therearound, the effective line parts of said cable between said first sheaves and said second sheaves mounted on said boom sections equaling the effective line parts between the sets of sheaves of said first block system such that the sets of sheaves of said first block system move apart at substantially the same rate as said second boom section moves relative to said first boom section, a drum for receiving cable from said block system, and means for rotating said drum to selectively wind in said cable to draw the sheaves of said block system together and thereby rotate said boom sections about the point of connection of said first boom section to said base structure.

5. A crane comprising:

a first boom section, a second boom section slidable longitudinally relative to said first boom section, a cable means connected between said first and second boom sections for translating said second boom section relative to said first boom section, means for actuating said cable means to translate said second boom section relative to said first boom section, said cable means comprising:

at least one first sheave attached to said first boom section, at least one second sheave attached to said second boom section, and a cable entrained alternately around said second sheaves and said first sheaves, such that drawing in said cable draws said second sheaves toward said first sheaves to translate said second boom section relative to said first boom section, said means for actuating said cable means comprising:

a winch mechanism about which said cable is wrapped, and means for selectively rotating said winch mechanism to draw in or let out said cable, a base structure pivotally supporting the end of said first boom section remote from said second boom section, and a first block system connecting said base structure and the end of said second boom section remote from said first boom section for receiving said cable from said winch mechanism, said first block system including two spaced sets of one or more sheaves for alternately receiving said cable therearound, said connection of said first block system to said base structure comprising:

a second block system including two spaced sets of one or more sheaves, means for attaching one said set of sheaves of said second block system to said first block system, means for attaching the second said set of sheaves of said second block system to said base structure, a cable entrained alternately around the two sets of sheaves of said second block system, a drum for receiving an end of said cable, and means for selectively rotating said drum to draw in said cable of said second block system and thereby pivot said boom sections about the pivotal attachment of said boom to said base structure.

6. The crane according to claim 1 wherein said means for drawing in said cable comprises:

a winch mechanism including a pair of drums spaced one from the other about which said cable is alternately wrapped, and means for selectively rotating one of said drums to draw in or let out said cable.

7. A crane comprising:

a first boom section, a second boom section slidable longitudinally relative to said first boom section, a cable means connected between said first and second boom sections for translating said second boom section relative to said first boom section, said cable means comprising:

at least one first sheave attached to said first boom section, at least one second sheave attached to said second boom section, a cable entrained alternately around said second sheaves and said first sheaves, and means for drawing in said cable to draw said second sheaves toward said first sheaves thereby translating said second boom section relative to said first boom section, said means for drawing in said cable comprising:

a winch mechanism including a pair of drums spaced one from the other about which said cable is alternately wrapped, and means for selectively rotating one of said drums to draw in or let out said cable, a base structure pivotally supporting one end of said first boom section, a first block system connecting said base structure and the end of said second boom section remote from said first boom section for receiving said cable from said winch mechanism, said first block system including two sets of one or more sheaves for alternately receiving said cable there around, and said connection of said first block system to said base structure comprising:

a second block system including two spaced sets of one or more sheaves, means for attaching one said set of sheaves of said second block system to said first block system, means for attaching the second said set of sheaves of said second block system to said base structure, a cable entrained alternately between the sheaves of said sets of sheaves of said second block system, a drum for receiving an end of said cable, and means for selectively rotating said drum to draw in said cable of said second block system and thereby pivot said boom sections about the pivotal attachment of said boom to said base structure.

8. The crane according to claim 1 wherein said first boom section comprises longitudinal frame members interconnected by transverse brace members, and wherein said second boom section comprises longitudinal frame members interconnected by transverse brace members, said second boom section being slidable longitudinally within said first boom section with said frame members of said second boom section being guided by said frame members of said first boom section.

9. The crane according to claim 8 further comprising:

bearing means attached to said longitudinal frame members and corresponding to the frame members of said second boom section to support the sliding of said second boom section relative to said first boom section.

10. A crane comprising:

a base, a first boom section pivotally attached at one end to said base, a second boom section slidably received within said first boom section, a third boom section slidably received within said second boom section, at least one first sheave attached to the first boom section, at least one second sheave attached to the second boom section, at least one third sheave attached to the second boom section in spaced relation with the second sheave, at least one fourth sheave attached to the third boom section, topping means including a first block system comprised of sets of sheaves secured between the base and the third boom section, at least one cable having one end fixed to one of the boom sections and extending about the first, second, third and fourth sheaves to the first block system, and means located between the first boom section and the topping means for actuating the cable to selectively telescope the second and third boom sections and adjust the topping means.

11. The crane according to claim 10 wherein the effective line parts of said first cable between said first and said second sheaves equal the number of effective line parts of said second cable between said third and said fourth sheaves and the active line parts between the sheaves of said first block system.

12. A crane comprising:

a base, a first boom section pivotally attached at one end to said base, a second boom section slidably received within said first boom section, a third boom section slidably received within said second boom section, cable means connected between said boom sections for telescoping said third boom section from said second boom section and said second boom section from said first boom section, said cable means comprising:

one or more first sheaves attached to said first boom section, one or more second sheaves attached to said second boom section, one or more third sheaves attached to said second boom section remote from said second sheaves, one or more fourth sheaves attached to said third boom section, a first cable entrained between said first and said second sheaves such that drawing in said first cable draws said second sheaves towards said first sheaves thereby telescoping said second boom section from said first boom section, a second cable entrained between said third sheaves and said fourth sheaves such that drawing in said second cable draws said fourth sheaves towards said third sheaves thereby telescoping said third boom section from said second boom section, and means for drawing said first and second cables, a winch mechanism about which said cable is wrapped, means for selectively rotating said winch mechanism to draw in or let out said cable, a first block system connected between said base and the end of said third boom section remote from said second boom section for receiving said first and second cables from said winch mechanism, said first block system including two spaced axes having a plurality of sheaves rotatable thereon for receiving said first and said second cables therearound, a drum for receiving cable from said first block system, and means for rotating said drum to selectively wind in said cable to draw the sheaves of said block system together and thereby rotate said boom sections about the point of connection of said first boom section to said base structure.

13. A crane comprising:

a base, a first boom section pivotally attached at one end to said base, a second boom section slidably received within said first boom section, a third boom section slidably received within said second boom section, cable means connected between said boom sections for telescoping said third boom section from said second boom section and said second boom section from said first boom section, said cable means comprising:

one or more first sheaves attached to said first boom section, one or more second sheaves attached to said second boom section, one or more third sheaves attached to said second boom section remote from said second sheaves, one or more fourth sheaves attached to said third boom section, a first cable entrained between said first and said second sheaves such that drawing in said first cable draws said second sheaves towards said first sheaves thereby telescoping said second boom section from said first boom section, a second cable entrained between said third sheaves and said fourth sheaves such that drawing in said second cable draws said fourth sheaves towards said third sheaves thereby telescoping said third boom selection from said second boom section, and means for drawing said first and second cables, a winch mechanism about which said cable is wrapped, means for selectively rotating said winch mechanism to draw in or let out said cable, a first block system connected between said base and the end of said third boom section remote from said second boom section for receiving said first and second cables from said winch mechanism, said first block system including two spaced axes having a plurality of sheaves rotatable thereon for receiving said first and said second cables therearound, and said connection of said first block system to said base structure comprising:

a second block system including at least two spaced sheaves, means for attaching one said sheave of said second block system to said first block system, means for attaching the second sheave of said second block system to said base structure, a cable entrained alternately around the sheaves of said second block system, a drum for receiving an end of said cable, and means for selectively rotating said drum to draw in said cable of said second block system and thereby pivot said boom sections about the pivotal attachment of said boom to said base structure.

14. The crane according to claim 10 further comprising:

a drum for receiving the cable from the first block system, and means for selectively collecting the cable to adjust the spacing of the sheaves in the first block system and thereby pivot the boom sections relative to the base.

15. The crane according to claim 10 further comprising:

a second block system comprised of sets of sheaves connected between the base and the third boom section, at least one second cable having one end fixed to the second block system and extending around the sheaves thereof, and means for selectively collecting the second cable to adjust the spacing of the sheaves in the first block system and thereby pivot the boom sections relative to the base.

16. The crane according to claim 10 wherein the means for actuating the cable comprises:

a drum having one section for receiving cable from the sheaves attached to the boom sections in one direction, and another section for supplying cable to the first block system in the opposite direction, and means for selectively rotating the drum.

* * * * *

UNITED STATES PATENT AND TRADEMARK OFFICE

CERTIFICATE OF CORRECTION

PATENT NO. : 4,166,542

DATED : September 4, 1979

INVENTOR(S) : John F. Bryan, Jr.

It is certified that error appears in the above-identified patent and that said Letters Patent are hereby corrected as shown below:

Line 6 of abstract, change "cables" to --cable--.

Column 3, line 54, after "system", insert --,--.

Column 3, line 55, delete "," after --system--.

Column 4, line 61, change "if" to --is--.

Column 5, line 21, change "104" to --140--.

Column 6, line 32, change "44" to --44a--.

Column 6, line 35, change "44" to --44b--.

Column 10, line 26, change "409a" to --490a---.

Column 11, line 39, change "10" to --610--.

Signed and Sealed this

*Eighteenth* Day of *December 1979*

[SEAL]

*Attest:*

SIDNEY A. DIAMOND

*Attesting Officer*

*Commissioner of Patents and Trademarks*